United States Patent [19]

Ali et al.

[11] 4,339,910

[45] Jul. 20, 1982

[54] OPEN-END SPINNING MACHINE

[75] Inventors: Ramadan A. Ali, Reutlingen; Heinz Muller, Metzingen; Karl-Heinz Lehmann, Altenriet; Peter Artzt, Reutlingen; Anton Schenek, Bempfingen, all of Fed. Rep. of Germany

[73] Assignee: Schubert & Salzer, Ingolstadt, Fed. Rep. of Germany

[21] Appl. No.: 172,297

[22] Filed: Jul. 25, 1980

[30] Foreign Application Priority Data

Aug. 3, 1979 [DE] Fed. Rep. of Germany ..... 2931567

[51] Int. Cl.[3] ..... D01H 7/882

[52] U.S. Cl. ..... 57/411

[58] Field of Search ..... 57/58.89, 58.95

[56] References Cited

U.S. PATENT DOCUMENTS

| | | | |
|---|---|---|---|
| 3,778,990 | 12/1973 | Bartling et al. | 57/58.95 X |
| 3,845,612 | 11/1974 | Chisholm | 57/58.89 X |
| 3,922,839 | 12/1975 | Sakurai et al. | 57/58.95 |
| 4,245,460 | 1/1981 | Stauffert et al. | 57/58.89 |

*Primary Examiner*—Donald Watkins

[57] ABSTRACT

An open-end spinning apparatus with a spinning rotor having an interior wall, a yarn takeoff channel opening and a fiber feed channel opening communicating with the interior of the spinning rotor. A suction opening (5, 50, 51) is connected to a source of reduced pressure and has its open end directed to the interior wall of the spinning rotor. The suction opening is positioned so that a suction air stream flowing therethrough is separated by a screen from the yarn takeoff channel opening and the fiber feed channel opening.

19 Claims, 5 Drawing Figures

OPEN-END SPINNING MACHINE

BACKGROUND OF THE INVENTION

The present invention relates to an open-end spinning apparatus with a spinning rotor into which opens a yarn takeoff channel and a fiber feed channel, and the internal space of which is connected to a source of reduced pressure.

The reduced pressure in the spinning rotor required for spinning is produced in most open-end spinning machines by means of their own source of reduced pressure, since the bores in the spinning rotor (DE-OS 2,651,551) for self-generation of reduced pressure lead to production of much noise and are easily dirtied, and the reduced pressure is always dependent on the rotational speed of the spinning rotor. When using external suction, independently of the rotational speed of the rotor, constant reduced pressure conditions are always present in the spinning rotor.

With separate sources of reduced pressure, the air is as a rule sucked away over the edge of the spinning rotor, through the gap between the spinning rotor and the rotor cover. The air thus undergoes strong friction and is strongly throttled; and as a result, dust entrained with the air is deposited on the rotor edge. These deposits break off from time to time and reach the collecting surface of the spinning rotor where they are again deposited and cause irregularities such as, for example, thick places, moire effects, or even breaks in the yarn.

It is also already known to introduce suction through the rotor cover so that no dust deposition on the rotor edge occurs (DE-OS 1,710,015, FIG. 1). Since yarn takeoff occurs here through the hollow rotor shaft and thus axially opposite the suction opening in the cover, the yarn when fed back into the spinning rotor during piecing-up is seized by the suction air stream in the cover, so that piecing-up with the reduced pressure operating for spinning is not possible. It is thus necessary to first feed into the spinning rotor the amount of fiber required for piecing-up, then to switch off the action of the source of reduced pressure, and to restart the action of the source of reduced pressure only after successfully piecing-up. This requires a very accurately timed and costly control of fiber feed, reduced pressure source or associated valves, thread backfeed, and yarn takeoff, so that there is a danger of a yarn break occurring before the reduced pressure and the fiber feed which operate in dependence on it are switched on again.

SUMMARY OF THE INVENTION

The purpose of the present invention is to avoid the disadvantages of the known apparatuses and to utilize their advantages. Thus, the object of this invention is to produce an open-end spinning apparatus which has a reduced pressure for spinning which is independent of the rotational speed of the rotor and a small tendency to deposition of dust, and which makes piecing-up possible in a simple manner without special control of the reduced pressure for spinning.

This object is attained according to the invention in that within the spinning rotor a suction opening, connected to a source of reduced pressure, is directed against the rotor wall such that up to the vicinity of the rotor wall the suction air stream is separate from the yarn takeoff path and from the fiber feed path. The separation of the suction opening from the yarn takeoff path has the result that the yarn is not exposed to any axial stream which could stretch it and hinder its reaching the collecting surface when it is fed back into the spinning rotor during piecing-up. Also, this suction air stream does not act intermittently on the yarn present in the takeoff so that the yarn obtained has a very uniform appearance and an increased breaking strength. A further advantage is that the yarn is found to be somewhat fuller than the open-end yarn obtainable up to now.

Due to the separation of the suction opening and the yarn takeoff path, the suction opening opens about radially into the interior of the spinning rotor. The air stream entering through the fiber feed channel into the interior and transporting the fibers therethrough needs to travel back a short path to reach this suction opening. Throttling does not occur. Because of this, a considerably smaller reduced pressure produced by the source of reduced pressure is sufficient to obtain the same effective reduced pressure in the spinning rotor than when suction occurs over the edge of the rotor. The separation of the suction opening from the fiber feed path ensures a more certain and undisturbed deposition of the fibers on the fiber slip wall of the spinning rotor and thus opposes loss of fibers, while the air stream, as a result of the arrangement of the suction opening according to the invention, has a substantially shorter path in the spinning rotor and, hence, leaves this earlier than was usual in the prior art.

Separation of the suction opening from the yarn takeoff path and from the fiber feed path can result from screening associated with the suction opening and having many possible designs in principle. For example, the yarn takeoff channel, the fiber feed channel and the suction opening can be arranged in a cylindrical or disk-shaped body which projects into the spinning rotor and reaches to the vicinity of the rotor wall. Advantageously, however, the screen is carried by a cover which covers the spinning rotor. According to a preferred embodiment of the invention, the screen is formed by a cover extension, the suction opening being arranged in its peripheral wall after the mouth of the fiber feed channel in the direction of rotation of the spinning rotor. Because of the cover extension, which has a closed peripheral wall apart from the opening of the fiber feed channel and the suction opening, a favorable air flow is obtained.

In order to prevent this air flow which passes through the fiber feed channel into the spinning rotor and leaves the latter again through the suction opening, from reaching the open edge of the spinning rotor and forming dust deposits there, the suction opening is advantageously constructed as a slot which extends in the peripheral direction of the spinning rotor and which is separated by a piece of wall from the plane passing through the end side of the spinning rotor.

The air stream takes a curved course in the spinning rotor. It has been found in this connection that it is advantageous for the suction opening to begin at an acute angle after the opening of the fiber feed channel, seen in the direction of rotation of the spinning rotor; according to the diameter of the spinning rotor, the covering of the spinning rotor and the rotor rotation speed provided, an angle between 15° and 45° has been found particularly appropriate. Since the air stream entering the spinning rotor through the fiber feed channel reaches the slot-shaped suction opening again at various speeds, the opening extends, according to a further feature of the invention, substantially over 90° of the peripheral direction of the spinning rotor. When the cover is retained and the spinning rotor is to be changed for one with another diameter, or if the speeds of rotation of the spinning rotor can be varied within wide limits, it is advantageous if the length of the arrangement of the slot-shaped suction opening can be adjusted by a stop which can be displaced in the peripheral direction of the cover extension.

It has been found to be particularly advantageous for the cross sectional surface of the suction opening to be 4 to 10 times the cross sectional surface of the opening of the fiber feed channel. In this way, the air stream leaving the spinning rotor has a speed such that it does not impair the fibers located on the fiber slip wall and sliding on the fiber collecting surface.

A particularly favorable and energy-saving guiding of the air is obtained according to the invention when the slot-shaped suction opening, together with the opening of the fiber feed, is located on the same contour line of the fiber slip wall of the spinning rotor. Apart from the ring of air revolving with the rotor, there arises only an air stream leaving the fiber feed channel which leads the fibers against the rotating rotor wall, but is itself deflected in the direction of rotation of the spinning rotor and leaves the spinning rotor again through the suction opening. This air stream flows substantially in the peripheral direction of the spinning rotor, so that no air streams arise which run transversely and cause disturbances.

Since the production of reduced pressure occurs through the cover, in principle a rotor housing is not necessary. However, in order to reduce the power requirements, according to a further feature of the invention, a housing is provided which closely encloses the spinning rotor and the internal contour of which appropriately matches the outer shape of the spinning rotor. In this way, the power requirement for driving the spinning rotor is quite considerably reduced, since the spinning rotor drives only negligibly small amounts of air which rotate with it.

The object of the invention gives better yarn quality than the known apparatuses, is simple and compact in construction, and over and above these saves energy. For example, the source of reduced pressure, to produce the usual reduced pressure in the spinning rotor, has to produce only 80% to 90% of the reduced pressure which would be required for suction removal over the rotor wall.

BRIEF DESCRIPTION OF THE DRAWINGS

The invention is further described below with reference to drawings in which are shown.

DESCRIPTION OF THE PREFERRED EMBODIMENT

Figure 1:
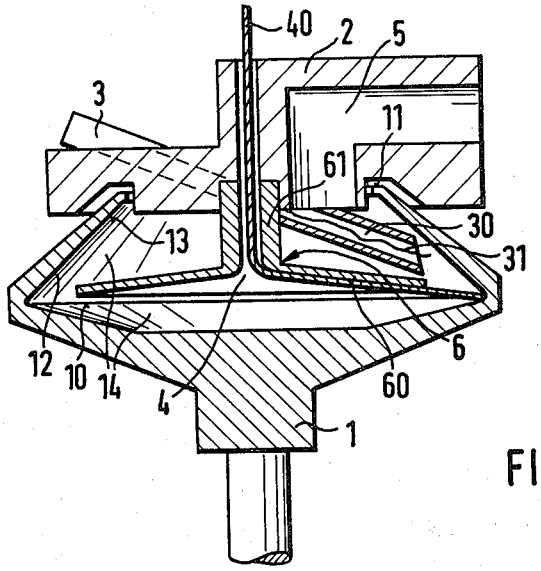
FIG. 1 is a longitudinal section through a first embodiment of the open-end spinning apparatus constructed according to the invention.

Embodiments of the invention are shown schematically in the figures with only the parts required for an understanding of the object of the invention being shown. The spinning rotor 1 of an open-end spinning apparatus, which is conventionally constructed apart from the described elements, is mounted in a mount (not shown) and conventionally driven. The spinning rotor 1, which apart from its open end 11 is completely closed, can have any given form. According to FIG. 5, it has a collecting surface 10 constructed as a collecting groove and also an open end side 11, with an inner wall, constructed as a fiber slip wall 12, extending between the end side 11 of the spinning rotor 1 and the collecting surface 10. A fiber feed channel 3 projects into the open end side 11 and is directed tangentially in the direction of rotation of the spinning rotor 1 against the fiber slip wall 12. The fiber feed channel 3 is associated with a supply and opening apparatus (not shown) by means of which a sliver, opened into individual fibers 31, is fed to the fiber feed channel 3. A yarn takeoff channel 4 also opens, coaxially of the spinning rotor 1, into the rotor, and yarn 40 produced in the spinning rotor 1 is withdrawn through it by conventional means.

A suction channel 53, connected to a source of reduced pressure (not shown), also projects into the spinning rotor 1, with a suction opening 52 at its end. The wall 54 of the suction channel 53 separates the region of influence of the suction opening 52 both from the yarn takeoff path through which the yarn 40 being taken off passes in the interior of the spinning rotor 1, and also from the fiber feed path.

The apparatus according to the invention operates as follows:

The required reduced pressure for spinning is produced in the internal space 14 of the spinning rotor 1 via the suction opening 52. Because of this reduced pressure, the fibers 31 are forwarded into the spinning rotor 1 with the aid of the air stream, acting as a transport medium. The region of direct influence of the suction opening 52 is kept separate from the fiber feed path by the wall 54 of the suction channel 53 as far as the vicinity of the fiber slip wall 12. As a result, the air is so strongly deflected because of the rotation of the spinning rotor 1 and the suction acting in the suction opening 52, that the fibers 31 cannot follow this deflection because of their inertia and are deposited on the fiber slip wall. To leave the spinning rotor 1, the air does not have to pass through any narrow places and, on this account also, loses only little energy. This is the basis on which the suction has very high efficiency.

When enough fibers 31 for piecing-up are fed to the collecting surface 10, the yarn 40 is introduced through the yarn takeoff channel 4 into the interior 14 of the spinning rotor 1 where it is centrifuged onto the collecting surface 10 owing to the centrifugal force produced by the rotating spinning rotor 1 and comes into contact with the fibers 31 deposited there.*/ Since the suction air stream produced by the suction opening 52 is sucked away from the fiber slip wall 12, this suction air stream does not adversely affect yarn 40, either on delivery back to the collecting surface 10 or after successful piecing up on withdrawal.

*/ Then the yarn 40 is withdrawn in known manner.

Figure 5:
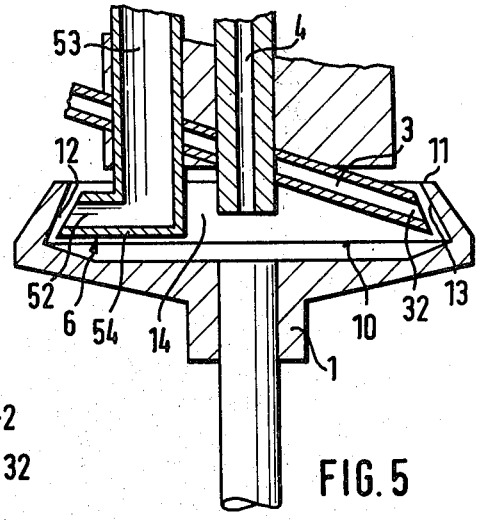
FIG. 5 is a longitudinal section through still another modified form of the invention.

In the embodiment shown in FIG. 5, the wall 54 of the suction channel 53 forms a screen for the suction air.

Figure 2:
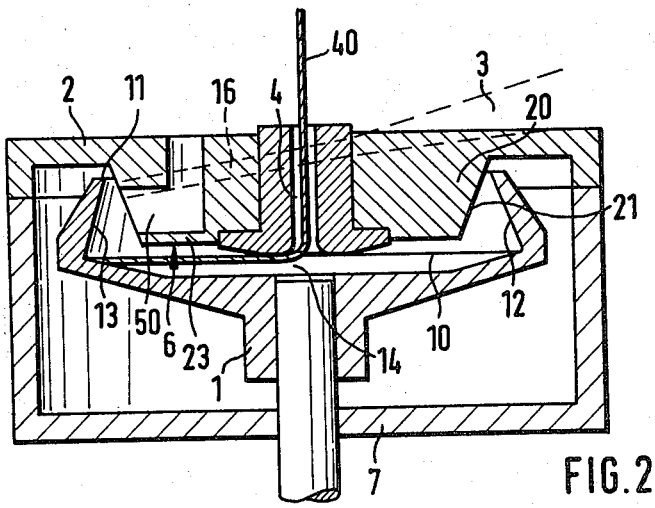
FIG. 2 is a longitudinal section through a modified form of the invention.

The screen can, however, be constructed differently, as shown in FIG. 2. According to the embodiment shown in FIG. 2, the open end side 11 of the spinning rotor 1 is sealed as well as possible by a cover 2 in order to completely prevent ingress or egress of air via the open rotor edge 13. This cover 2 carries the fiber feed channel 3 and the yarn takeoff channel 4.

In FIG. 1, a suction opening 5, connected to a source (not shown) of reduced pressure, is provided in the cover 2 and opens axially into the interior 14 of the spinning rotor 1. The suction opening 5 has an associated screen 6 which is carried by the cover 2. The screen 6 is constructed according to FIG. 1 as a separator disk 60 which is held spaced from the cover 2 by the tube piece 61. The separator disk 60 separates the yarn takeoff path through which passes the yarn 40 being taken off in the interior 4 of the spinning rotor 1 from the direct region of influence of the suction opening 5 since the suction opening 5 sucks the air from the region of the fiber slip wall 12 of the spinning rotor 1. The region of influence of the suction opening 5 is also separated from the fiber feed path in the interior space 14 of the spinning rotor. In the embodiment shown, this results from the prolongation 30 of the fiber feed channel 3 via the underside of the cover 2 as far as the vicinity of the fiber slip wall 12.

Figure 3:
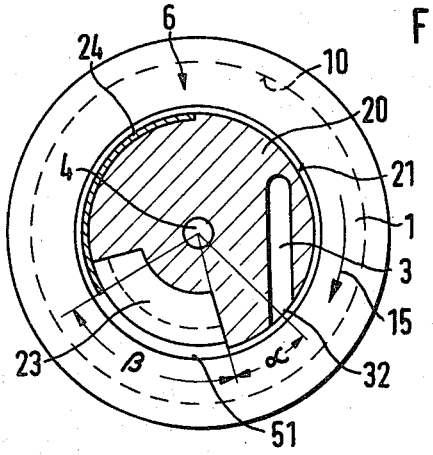
FIG. 3 is a plan view of a spinning rotor combined with a cross section through the cover extension constructed according to the invention.

As an alternative to an extension 30 of the fiber feed channel 3, a wall can also be provided as a screen 6 for the suction opening 5 from the fiber feed path and connects the separator disk 60 with the cover 2. This wall is thus located in the direction of rotation (see FIG. 3) of the spinning rotor 1 between the opening of the fiber feed channel 3 on the underside of the cover 2 and the suction opening 5. Against the direction of rotation 15 of the spinning rotor 1, such a wall between the fiber feed path and the suction opening 5 can, under some circumstances, be dispensed with.

As already mentioned, the spinning rotor can be of various designs. All that has to be paid attention to in the various designs of the spinning rotor 1 is that the guiding of the air is not altered. Thus, different shapes of the spinning rotor 1 and its collecting surface, the arrangement of the yarn takeoff channel 4 in the rotor shaft or even the construction of the rotor shaft as a yarn takeoff channel 4 are possible; however, bores in the spinning rotor 1 must not be provided since this adversely affects the guiding of the air in the spinning rotor 1.

In order to optimize the air flows and to prevent the formation of air vortices so that the yarn quality is further raised, a modified form of the invention is constructed according to FIG. 2. Here the screen 6 is formed by a cover extension 20, the suction opening 50 being arranged in its peripheral wall 21 after the fiber feed channel 3 in the direction of rotation 15 (FIG. 3) of the spinning rotor 1, and being separated by a wall 23 from the yarn takeoff path. The cover extension 20 can in this case have a cylindrical shape or one which tapers over the whole length or only over a partial region. The air revolving with the spinning rotor 1 is not disturbed by the circular peripheral wall 21 of the cover extension 20 while the air stream entering the spinning rotor 1 through the fiber feed channel 3 can still leave the interior 14 of the spinning rotor 1 again after a short path.

In principle, the suction opening 50 can have any desired shape. However, in order to exclude deposition of dust on the rotor edge 13, the air stream is expediently kept away from the rotor edge 13. This takes place, according to FIGS. 3 and 4, by design of the suction opening 51 as a slot which extends in the peripheral direction of the cover extension 20. This slot is kept so narrow that the suction opening 51 is separated by a piece of wall 22 of the cover extension 20 from the plane 16 passing through the end side 11 of the spinning rotor 1.

The air entering through the fiber feed channel 3 into the spinning chamber 1 takes an arcuate course between the opening 32 of the fiber feed channel 3 and the suction opening 50 or 51. It has been found to be particularly advangateous if the suction opening 50 or 51 begins, as seen in the direction 15 of rotation of the spinning rotor 1, in an acute angle $\alpha$ after the opening 32 of the fiber feed channel 3. This arcuate course changes when the spinning parameters are changed. With a greater diameter, with a greater distance between the opening 32 of the fiber feed channel 3 and the fiber slip wall 12 of the spinning rotor 1, and with a greater speed of rotation of the rotor, the arc described by the air flow is greater than when these values are smaller. It has been found that with a small rotor diameter, small distance between the opening 32 and the fiber slip wall 12, and with a low rotor rotation speed, an angle $\alpha$ of the order of magnitude of about 15° is entirely satisfactory, while when these values are larger, it is preferably of the order of magnitude of about 45°. In order to permit certain changes of the spinning conditions so that spinning rotors 1 can be interchanged within certain limits without the cover 2 having to be changed, it is advantageous for the slot-shaped opening 51 to have a certain length. The widening course of the flow is also taken into account in this way. A length of the suction opening 51 extending over an angle $\beta$ of about 90° of the periphery of the cover extension 20 has been found to be suitable for most cases. If greater changes of the parameters influencing the air flow are not excluded from the outset, it is expedient for the slot-shaped suction opening 51 to be adjustable by a cover 24 (FIG. 3) which is displaceable in the peripheral direction of the cover extension 20. Control of the displacement can take place by conventional means, which are therefore not shown. The length of the suction opening 51 can be changed by such a cover 24. However, it is also possible to modify the stop 24 such that it is constructed as a cover for the suction opening having a window-like opening 51. The size of the suction opening 51 is then not changed, but only its position. Combined stops are of course also possible which permit both the size and the position of the suction opening 51 to be changed.

It has been found to be particularly favorable for the parallel position of the fibers 31 for the air stream circulating with the spinning rotor 1 not to be distorted by air streams running transversely to it. The aim is thus to guide the air stream entering the spinning rotor 1 through the fiber feed channel 3 and leaving again through the suction opening 51 parallel to the collecting surface 10. For this purpose, the slot-shaped suction surface 51 together with the opening 32 of the fiber feed channel 3, is located according to FIG. 4 on the same contour line 17 of the fiber slip wall 12 of the spinning rotor 1.

In order to achieve a good separation of the fibers 31 from the air stream entering through the fiber feed channel 3, the air stream is slowed from the high speed at which it reaches the spinning rotor 1 to a lower speed, while the entrained fibers 31 get onto the fiber slip wall 12 at their previous speed, are deposited there, and slide because of centrifugal force to the collecting surface 10. So that the fibers 31 present on the fiber slip wall 12 are not adversely affected, the centrifugal force acting on the fibers 31 must overcome the action of the air leaving the interior 14 of the spinning rotor 1 through the suction opening 51. This is achieved by having the cross sectional surface of the suction opening about 4 to 10 times the cross sectional surface of the opening 32 of the fiber feed channel 3.

In connection with the embodiments of the invention as described, a conventional housing 7 can be provided for the spinning rotor 1. Since the production of the reduced pressure for spinning is through the cover 2, such a housing 7 to receive the spinning rotor 1 is, however, not absolutely necessary.

Figure 4:
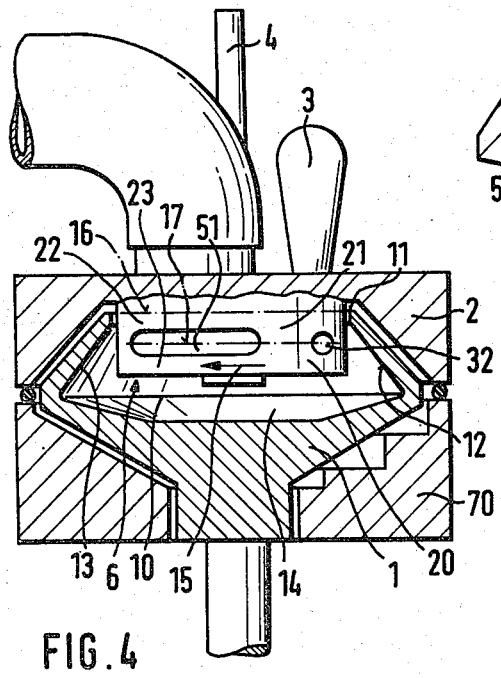
FIG. 4 is a longitudinal section through an openend spinning apparatus constructed according to the invention which is designed to be particularly energy-saving.

The air surrounding the spinning rotor 1 is likewise set in rotation by the rotating spinning rotor 1 so that a relatively high friction occurs between the spinning rotor 1 and the air. In order to reduce this friction, and hence the power requirement for driving the spinning rotor 1, the amount of the driven air is expediently reduced. This is done by arranging the spinning rotor 1 in a housing 70 which closely encloses it (FIG. 4). For example, the housing 70 has a stepped internal contour, as shown on the right-hand side of FIG. 4. A further reduction of the amount of driven air, and hence of the driving power load, is obtained by matching the inner contours of the housing 70 and of the cover 2 covering this housing 70 so that a minimum gap remains between the housing 70 or cover 2 and the spinning rotor 1. Such a design of the housing 70 is of advantage not only in connection with the suction process according to the invention, as in FIGS. 1 through 4, but can also be applied to suction through the cover according to DE-OS 1,710,015, FIG. 1, or DE-AS 1,560,298, FIG. 1, or through the hollow rotor shaft according to DE-AS 1,560,298, FIG. 3.

The object of the invention can be modified in many ways, the elements as shown and described being interchanged with each other or with equivalents. The apparatus according to the invention can, in particular, be applied with and without a rotor housing. The suction opening 5, 50, 51, 52 as a rule is arranged in a removable or hinged cover 2, and is connected, together with a number of suction openings 5, 50, 51 of adjacent spinning positions with a common suction channel (not shown).

What is claimed is:

1. An open-end spinning apparatus with a spinning rotor having an interior wall, a yarn takeoff channel opening and a fiber feed channel opening communicating with the interior of said spinning rotor, and a source of reduced pressure, the improvement comprising:

a suction opening (5, 50, 51) connected to said source of reduced pressure and being directed to said interior wall, said suction opening being positioned so that a suction air stream flowing therethrough is separated from the path of said yarn between said interior wall and said yarn takeoff channel opening and the path of fibers between said fiber feed channel opening and said interior wall.

2. The open-end spinning apparatus as set forth in claim 1 further comprising:

a screen (6) carried in said rotor separating said suction opening from said path of yarn inside the rotor.

3. The open-end spinning apparatus as set forth in claim 2 further comprising:

a cover provided for said spinning rotor, and said screen being carried by said cover.

4. The open-end spinning apparatus as set forth in claim 2 further comprising:

a cover provided for said spinning rotor, said suction opening (50,51) being provided in a peripheral wall of said cover arranged in the direction of rotation (15) of said spinning rotor (1) after said fiber feed channel (3).

5. The open-end apparatus as set forth in claim 1 further comprising:

a cover provided for said spinning rotor;

a cover extension (20) having a peripheral wall extending into said rotor, and said suction opening being arranged in the form of a slot in said peripheral wall of said cover extension.

6. The open-end spinning apparatus as set forth in claim 5 further comprising:

an end face (11) provided on said spinning rotor (1);

a section of wall (22) separating said suction opening from a plane (16) passing through said end face (11) of said spinning rotor (1).

7. The open-end spinning apparatus as set forth in claim 1 further comprising:

said suction opening (5, 50, 51) seen in the direction of rotation (15) of said spinning rotor (1), begins in an acute angle ($\alpha$) after said fiber feed channel opening 32.

8. The open-end spinning apparatus as set forth in claim 7 further comprising:

said suction opening (5, 50, 51) seen in the direction of rotation (15) of said spinning rotor (1), begins 15° to 45° after said fiber feed channel opening (32).

9. The open-end spinning apparatus as set forth in claim 5 further comprising:

said slot-shaped suction opening (51) extends substantially over 90° in the peripheral direction of said spinning rotor.

10. The open-end spinning apparatus according to claim 5 further comprising:

an adjustable cover 24 provided for said slot-shaped suction opening (51) displaceable in the peripheral direction of said cover extension.

11. The open-end spinning apparatus as set forth in claim 1 further comprising:

said suction opening (5, 50, 51) having a cross-section four to ten times the cross-section opening (32) of said fiber feed channel.

12. The open-end spinning apparatus as set forth in claim 5 further comprising:

said slot-shaped suction opening (51) is located at the same height (17) relative to the interior wall (12) of said spinning rotor (1) as said opening (32) of said fiber feed channel (3).

13. An open-end spinning apparatus according to claim 1 further comprising:

a housing which closely encloses said spinning rotor.

14. An open-end spinning apparatus according to claim 13 further comprising:

an inner contour of said housing (7) corresponding to the external form of said spinning rotor (1).

15. The open-end apparatus as set forth in claim 2 further comprising:

said screen (6) having a peripheral wall extending into said rotor (1), and said suction opening being arranged in the form of a slot in said peripheral wall of said screen.

16. The open-end spinning apparatus as set forth in claim 15 further comprising:

an end face (11) provided on said spinning rotor (1);

a section of wall (22) separating said suction opening from a plane (16) passing through said end face (11) of said spinning rotor (1).

17. The open-end spinning apparatus as set forth in claim 15 further comprising:

said slot-shaped suction opening (51) extends substantially over 90° in the peripheral direction of said spinning rotor.

18. The open-end spinning apparatus according to claim 15 further comprising:

an adjustable cover 24 provided for said slot-shaped suction opening (51) displaceable in the peripheral direction of said screen (6).

19. The open-end spinning apparatus as set forth in claim 15 further comprising:

said slot-shaped suction opening (51) is located at the same height (17) relative to the interior wall (12) of said spinning rotor (1) as said opening (32) of said fiber feed channel (3).

* * * * *